United States Patent [19]

Gesing et al.

[11] Patent Number: 4,495,047

[45] Date of Patent: Jan. 22, 1985

[54] ELECTROLYTIC REDUCTION CELLS

[75] Inventors: Adam J. Gesing; Ernest W. Dewing, both of Kingston, Canada

[73] Assignee: Alcan International Limited, Montreal, Canada

[21] Appl. No.: 391,405

[22] Filed: Jun. 23, 1982

[30] Foreign Application Priority Data

Jun. 25, 1981 [GB] United Kingdom ..... 8119588

[51] Int. Cl.[3] ..... C25C 3/08; C25C 7/02; C25B 11/12

[52] U.S. Cl. ..... 204/245; 204/294; 204/289

[58] Field of Search ..... 204/67, 243 R-247, 204/294, 290 R, 288-289

[56] References Cited

U.S. PATENT DOCUMENTS

| | | | |
|---|---|---|---|
| 4,177,128 | 12/1979 | Rahn | 204/243 R |
| 4,231,853 | 11/1980 | Rahn | 204/243 R |
| 4,297,180 | 10/1981 | Foster, Jr. | 204/67 |
| 4,308,114 | 12/1981 | Das et al. | 204/67 |
| 4,308,115 | 12/1981 | Foster, Jr. et al. | 204/67 |
| 4,338,177 | 7/1982 | Withers et al. | 204/290 R X |
| 4,349,427 | 9/1982 | Goodnow et al. | 204/243 R |
| 4,376,690 | 3/1983 | Kugler | 204/294 |
| 4,383,910 | 5/1983 | Richards | 204/243 R |
| 4,392,925 | 7/1983 | Alder et al. | 204/67 |
| 4,396,481 | 8/1983 | Pawlek et al. | 204/243 R X |
| 4,410,403 | 10/1983 | Jacobs et al. | 204/243 R X |

FOREIGN PATENT DOCUMENTS

| | | | |
|---|---|---|---|
| 2065174 | 6/1981 | United Kingdom | 204/243 R |

*Primary Examiner*—Donald R. Valentine

*Attorney, Agent, or Firm*—Cooper, Dunham, Clark, Griffin & Moran

[57] ABSTRACT

In an electrolytic reduction cell for the production of a molten metal by electrolysis of a molten electrolyte, the product metal collects on a cathodic carbon floor having embedded steel current collector bars for leading out the cathodic current. In order to reduce the wave motion of the metal due to interaction of horizontal currents in the product metal with the magnetic fields due to currents in conductors associated with the cell, electrically non-conductive barrier members are arranged on the floor of the cell transversely of horizontal currents in the product metal. Such barrier members have at least a surface layer of material resistant to product metal and extend upwardly from the cell floor to a height approximating to the normal maximum operating level of product metal.

8 Claims, 4 Drawing Figures

ELECTROLYTIC REDUCTION CELLS

The present invention relates to the construction of reduction cells for the production of metals in molten form by the electrolysis of molten electrolytes.

In one well known example of processes carried out in an electrolytic reduction cell, aluminium is produced by electrolysis of alumina in a fused fluoride electrolyte and the present invention is hereinafter described in relation to that process while being applicable to electrolytic reduction cells in which similar electrolytic reduction processes, involving similar problems, are carried out.

In a conventional electrolytic reduction cell for the production of aluminium the molten electrolyte, which is less dense than the product metal, is contained beneath a frozen crust of feed material. The cathode of the cell lies beneath the electrolyte and is usually constituted by the floor of the cell. The product metal collects at the bottom of the cell and in most instances is the effective cathode of the cell. Product metal is removed from the cell at intervals by a metal tapping operation which is performed by means of a syphon tube inserted through a hole, broken in the crust.

One drawback experienced with conventional electrolytic reduction cells is that the electromagnetic forces associated with the very high electric currents flowing through the molten metal and through the current conductors associated with the cell give rise to wave motion in the molten metal. The practical effect of such motion is that to avoid intermittent shorting of the cell by contact between the anode(s) and the molten metal it is necessary to maintain a greater distance between the anode(s) and the datum position (nominal level of the upper surface of the molten metal) of the cathode than is theoretically required. The consequence of employing the anode/cathode distance found necessary for a conventional electrolytic reduction cell is the dissipation of a substantial proportion of the energy input in overcoming the cell electrolyte resistance and very substantial energy savings could be achieved if the cell could be operated with a smaller anode/cathode distance.

In a conventional electrolytic reduction cell of the present type, the floor of the cell is rectangular and is formed of carbon blocks, in which transverse steel collector bars extending out of the cell are embedded in electrical contact with the carbon. The cathode current tends to flow outwardly in the molten metal towards the side wall of the cell because the molten metal provides a current path of lower resistance than the path extending downwardly through the central area of the cathode floor blocks and outwardly through the length of the collector bars from the central area of the cell. It is the interaction of these large horizontal components in the cathode current with the magnetic field existing in the cell which give rise to the electromagnetic forces producing circulatory movement and wave motion in the molten metal.

It is an object of the present invention to arrange an electrolytic reduction cell in such a manner that the horizontal components of the cathode current in the molten metal are substantially reduced, and at the same time restrict the wave motion and metal circulation.

It is already known to reduce the horizontal components of the cathode current by special arrangements of the collector bar system, for example by the system described in U.S. Pat. No. 4,194,959.

The arrangement provided by the present invention may be used in place of or to complement such special arrangements.

In its widest aspects the present invention provides electrically non-conductive barrier members at the floor of the cell, such barrier members being arranged so that they extend upwardly from the floor of the cell to a height approximating to the maximum level of the molten aluminium (the level of the molten aluminium immediately before tapping). The electrically non-conductive barrier members reduce horizontal electrical currents in the molten metal and also act as baffles to check the flow of electrical currents and of molten metal transversely of the barrier members. In the present context the term electrically non-conductive is applied to any material having an electrical resistivity substantially higher than the steel collector bars ($>1.2\mu\Omega m$) and which, when barriers are made from such material, effectively displace the horizontal currents from the aluminium pool to the steel collector bars.

In most instances the barrier members are arranged to extend longitudinally of the rectangular cell to reduce horizontal current components flowing outwardly parallel with the collector bars. In such case several barrier members are arranged parallel with the longitudinal axis of the cell, and therefore transverse to the direction of current flow. Suitably adjacent barrier members are spaced apart by a distance in the range of 20–100 cms. and the thickness of the individual barrier members is preferably in the range of 5–25 cms.

The barrier members preferably extend the full length of the cell, but may terminate somewhat short of the end walls of the cell at a location adjacent to but outwardly of the end edges of the anode shadow area. It may be desirable to provide transversely extending barrier members at one or more locations to reduce longitudinal horizontal current components in the molten metal and to reduce longitudinal wave movement in the molten metal. Alternatively it may be desirable to locate energy-absorbing transversely extending baffle members of the type described in co-pending British Patent Application Ser. No. 8,119,590 at least between the outer pair of barrier members adjacent the side walls of the cell and/or between the outer barrier member and the cell wall.

Where longitudinal wave motion exists in the molten metal, leading to greater depth of molten metal towards one end of the cell, there will also be horizontal current components in the longitudinal direction. Reduction of such currents and reduction of longitudinal wave motion can be achieved by use of transverse non-conductive barrier members preferably extending for the full width of the cell.

The barrier members are required to be electrically non-conductive at least in a direction perpendicular to their length to perform their primary function. They also require to be resistant to attack by molten aluminium and are also preferably resistant to attack by the molten electrolyte employed in the cell. The barrier members may be formed with an electrically non-conductive core and a thin surface protective coating, which may itself be electrically conductive, but insufficient to provide a substantial current leakage path transversely of the barrier. Thus the barrier members may have an alumina core, coated with a thin protective layer of $TiB_2$ or other protective material such as titanium carbide or titanium nitride.

It has already been proposed in British Patent Specification No. 2,069,530 to employ a packed bed of shapes formed of electroconductive, resistant ceramic material in the molten metal cathode layer to damp metal flow in an electrolytic reduction cell. Such a packed bed of ceramic shapes, such as $TiB_2$ ceramic shapes, or other arrangement of ceramic shapes may be employed with the electrically non-conductive barriers of the present invention, such bed being arranged between the barrier members (or some of them). Preferably the top of the bed of the ceramic shapes is arranged to be approximately at the minimum level (the level after tapping) of the molten aluminium in the cell, so that the individual ceramic shapes remain almost completely submerged in molten aluminium throughout the cell operation.

The difference in height between the top of the packed bed and the top of the barriers is preferably about 1.5 cms, being typically the extent of the reduction in depth of the molten metal in the cell during the course of a tapping operation, thus ensuring that the top surface of the barrier members remain uncovered by molten metal substantially through a normal 24 hour cell operating cycle.

In an alternative arrangement the reduction cell may be provided with one or more selective filters of the type described in co-pending British Patent Application Ser. No. 8,119,589. Such filters permit the passage of molten metal whilst obstructing the passage of the molten electrolyte and thus provide a means for maintaining a substantially constant metal level in the cell by draining off molten product metal as rapidly as it is formed in the cell. Where such a selective filter is employed the top of the bed of ceramic shapes may be at substantially equal height with the barrier members.

In the accompanying drawings.

Figure 1:
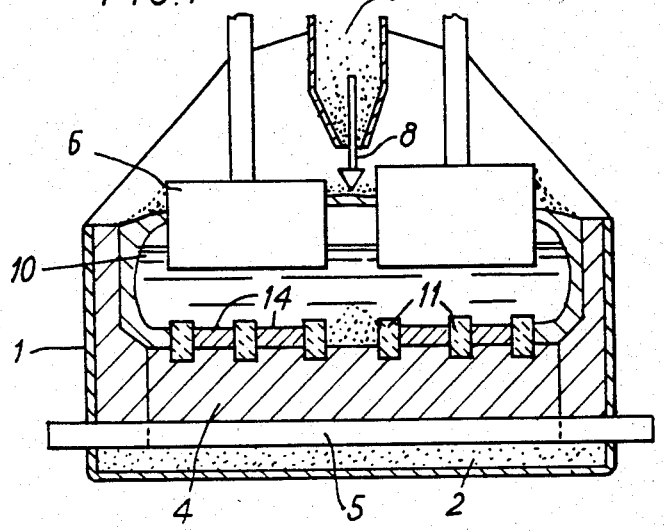
FIG. 1 is a diagrammatic cross section of one form of electrolytic reduction cell in accordance with the invention.

The electrolytic cell illustrated in FIG. 1 comprises a steel casing 1, lined with a layer of thermal and electrical insulation 2. It includes a conventional floor structure formed of carbon blocks 4 and transverse steel collector bars 5 at conventional intervals along the cell.

Figure 2:
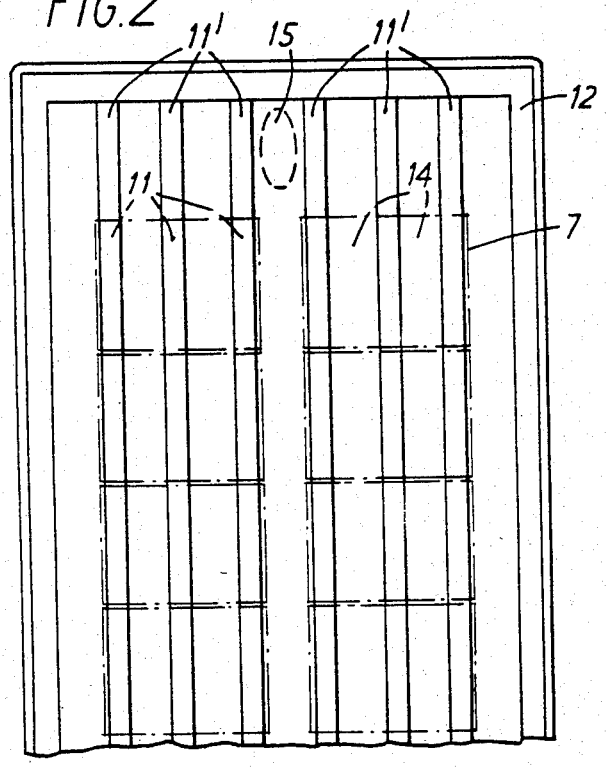
FIG. 2 is a diagrammatic plan view of the cathode of the cell of FIG. 1.

The cell includes two rows of prebaked anodes 6. The shadow area of such anodes are indicated in dotted lines at 7 in FIG. 2.

The cell includes a crust breaker 8 arranged between the rows of anodes 6 for feeding alumina from a hopper 9 into the cell electrolyte 10.

Barrier members 11, formed of alumina with a protective $TiB_2$ coating, are inset into the carbon floor blocks 4 and extend upwardly by a distance of 5–10 cms in the present instance.

The barrier members 11 extend to the ends of the area lying in the shadow of the anodes 6 but are of reduced height between the anode shadow area and the end walls 12 of the cell. Between the barrier members 11 lying in the anode shadow a filling 14 of $TiB_2$ ceramic shapes or other ceramics resistant to attack by molten product metal and molten cell electrolyte are provided to act as a damper for lateral and longitudinal flow of molten metal in the cell in the area lying in the anode shadow. The product metal released at the cathode accumulates in the cell and is syphoned out at a well 15 at one end of the cell, the height of barrier members 11 being locally reduced at 11' to allow accumulation of metal in well 15 to take place.

The difference in height between the top of the barrier members 11 and the top of the packed beds 14 is such that the metal level between successive tapping operations increases by approximately the same amount.

The cell is preferably operated in such a way that the metal level falls to the level of the top of the packed bed after tapping so that the packed bed remains substantially completely submerged at all times. The metal level rises to approximately the top of the barrier members at the next tapping, but does not rise substantially above such barriers to avoid the presence of a substantial film of molten metal in which transverse horizontal currents might flow.

It can readily be understood that the non-conductive barrier members 11 substantially change the path of the cathode current, flowing from the electrolyte to the collector bars 5 by limiting the transverse current flow in the molten metal.

Figure 3:
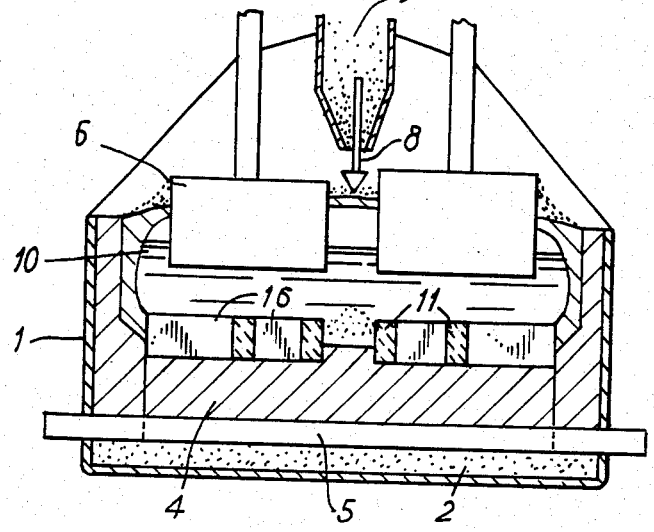
FIG. 3 is a diagrammatic cross section of an alternative arrangement utilizing both longitudinal and transverse barriers.
Figure 4:
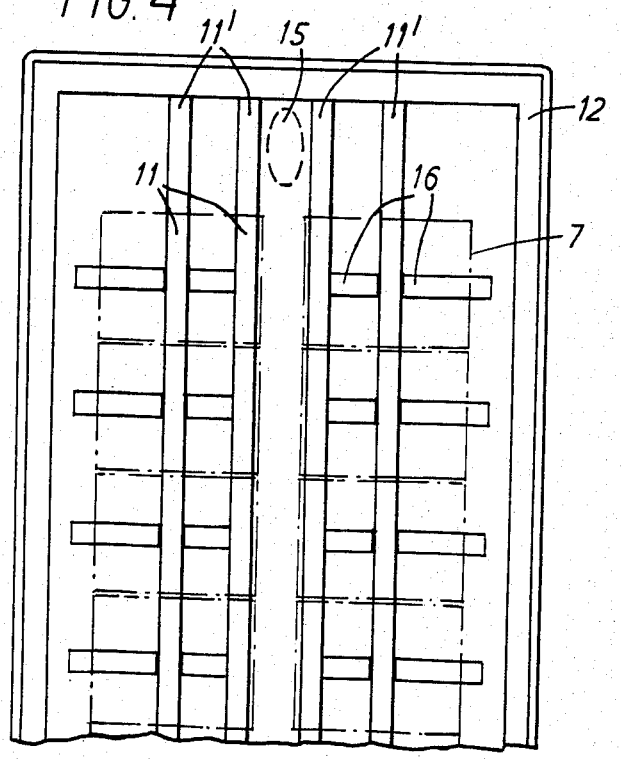
FIG. 4 is a diagrammatic plan view of the cell shown in FIG. 3.

In the alternative design shown in FIGS. 3 and 4 non-conductive transverse barriers 16 are used in conjunction with longitudinal barriers in order to eliminate longitudinal horizontal currents and restrict the longitudinal sloshing motion of the metal.

The transverse barriers are formed with very small notches or apertures (not shown) sized so as to permit produced metal to flow at a very slow rate to the well 15 with the result that longitudinal horizontal currents in the molten metal are held to a low value.

In the claims appended hereto the term carbon floor also includes a floor which has a surface layer of titanium diboride or other electrically conductive refractory material, resistant to attack by molten metal, and an underlying carbon layer, in contact with steel collector bars.

We claim:

1. An electrolytic cell for the production of metals by electrolysis of a molten electrolyte which is less dense than the product metal, said cell including a cathodic carbon floor having steel collector bars embedded therein, and barrier members arranged to extend upwardly from the cell floor to a height approximating to the normal maximum operating level of product metal in the cell, said barrier members being electrically non-conductive at least in a direction perpendicular to their length and having at least a surface layer of material resistant to product metal, said barrier members being arranged transversely to the flow of horizontal currents in the product metal on the cathodic cell floor, wherein a plurality of said barrier members, spaced apart, are arranged substantially parallel with the longitudinal axis of the cell.

2. An electrolytic reduction cell according to claim 1 in which the space between adjacent barrier members is in the range of 20–100 cms.

3. An electrolytic reduction cell according to claim 1 in which the barrier members extend for the full length of the cell floor.

4. An electrolytic reduction cell according to claim 3 in which the vertical extent of the barrier members is reduced between the end wall of the cell and the adjacent end of the anode shadow area.

5. An electrolytic reduction cell according to claim 1 in which the space between at least one pair of adjacent barrier members is provided with a filling of metal flow-resisting ceramic shapes, resistant to attack by molten product metal and molten cell electrolyte.

6. An electrolytic reduction cell according to claim 1 further including transversely arranged, electrically non-conductive barrier members at two or more locations, said transverse barrier members extending to substantially the same level as the longitudinal barrier members.

7. An electrolytic reduction cell according to claim 6 in which said transverse barrier members extend laterally to locations laterally outwardly of the adjacent outermost longitudinal barrier member.

8. An electrolytic reduction cell according to claim 7 in which said transverse barrier members extend to the side walls of the cell and very fine passageways are formed therein, such passageways being sized to permit product metal to flow to a collection well at the end of the cell at a very slow rate.

* * * * *